US005279353A

United States Patent [19]

Nielsen, Sr. et al.

[11] Patent Number: 5,279,353

[45] Date of Patent: Jan. 18, 1994

[54] METHOD AND APPARATUS TO EFFECT A FINE GRAIN SIZE IN CONTINUOUS CAST METALS

[76] Inventors: William D. Nielsen, Sr., 40163 Banks Rd., Grafton, Ohio 44044; Thomas D. Nielsen, 115 Preston, Elyria, Ohio 44035

[21] Appl. No.: 893,464

[22] Filed: Jun. 4, 1992

[51] Int. Cl.[5] ..... B22D 11/10

[52] U.S. Cl. ..... 164/489; 164/465; 164/421; 164/133; 222/594

[58] Field of Search ..... 164/488, 489, 439, 421, 164/464, 465, 133, 900; 222/594

[56] References Cited

U.S. PATENT DOCUMENTS

| | | | |
|---|---|---|---|
| 2,466,612 | 4/1949 | Phillips et al. | 164/465 |
| 3,342,252 | 9/1967 | Wood et al. | 164/427 |
| 3,375,863 | 4/1968 | Atkin et al. | 164/421 |
| 3,794,102 | 2/1974 | Binder | 164/421 |
| 4,000,773 | 1/1977 | Sevastakis | 164/465 |
| 4,154,291 | 5/1979 | Nielsen . | |
| 4,315,538 | 2/1982 | Nielsen . | |

*Primary Examiner*—Richard K. Seidel
*Assistant Examiner*—Erik R. Puknys
*Attorney, Agent, or Firm*—Fay, Sharpe, Beall, Fagan, Minnich & McKee

[57] ABSTRACT

Method and apparatus used for continuous casting of copper alloy rods and tubes for obtaining a fine grain size therein. Liquidus copper alloy material flows from a reservoir area or crucible into a continuous casting die through spaced apart feed slots disposed in the casting die cap, thereby effecting agitation of the liquidus material, which prevents the formation of thermal gradients large enough to produce gross directional solidification of the alloy at the liquid-solid state transition zone. The desired agitation is effected by altering the number, location, size and angle of the feed slots in accordance with formulas provided for that purpose.

10 Claims, 5 Drawing Sheets

METHOD AND APPARATUS TO EFFECT A FINE GRAIN SIZE IN CONTINUOUS CAST METALS

BACKGROUND OF THE INVENTION

This invention pertains to the art of continuous casting and more particularly to continuous casting of tubes and round shaped rods, although it is also applicable to the casting of other shapes.

The invention is particularly applicable to a method and apparatus for effecting a fine grain structure in continuous cast copper alloy rods and tubes of various cross-sections and will be described with particular reference thereto. Those skilled in the art, however, will appreciate that the invention has broader applications and may be adapted for use with other alloys or materials in other environments.

In continuous casting of rods and tubes, one type of general casting system employed utilizes a stationary die wherein the casting is intermittently moved generally longitudinally in order to effect the required casting conditions. During a so-called withdrawal stroke, the casting moves fast enough so that only liquid metal enters the cooled length of the die for causing intimate die metal contact. This stroke is followed by a dwell period during which the casting is stopped or slowed down so that it will exit from the solidification zone at the proper temperature.

Heretofore, in continuous casting of copper and copper alloy rods and tubes using the above-described as well as other techniques, gross directional solidification occurred in the rods during alloy transition from the liquid to the solid state. Such gross directional solidification resulted in the development of crystals or grains which grew generally opposite to the direction of heat flow. The grains were usually quite long in the direction of casting and coarse to fine at right angles to that direction. As a result, cold drawing or working of continuous cast copper alloy rods had previously been very difficult or impossible due to the thick grain boundaries generally associated with these structures. Attempts at such cold drawing had undesirably caused cracks and imperfections to appear in the rods as a result of the coarse grains. This, in turn, generated scrap and/or unacceptable end products.

Moreover, if the liquid metal is too hot and/or the casting speed too slow, the grain structure takes on a coarse elongated configuration generally in the direction of casting. Such grain structure is wholly undesirable for metals which are to be subsequently cold drawn. Thus, while it is possible to vary the casting parameters within normal casting practice so as to alter the grain structure of the cast rod, it had not been possible to alter these parameters by an amount, or to the degree, necessary to effect a grain structure which was readily conducive to cold working.

It has been known to be beneficial to all casting and metal working schemes to have the grain boundaries be as thin as possible. For this reason, it was considered desirable to develop an arrangement which would readily facilitate obtaining such fine grain structures in continuous cast copper alloy rods and tubes. Such rods and tubes would then satisfactorily accommodate subsequent cold drawing or working. Thus, U.S. Pat. No. 4,315,538 disclosed a method and apparatus to effect a fine grain size in continuous cast metals. This involved the use of a continuous casting die totally submerged in a reservoir of liquid alloy material and the use of feed openings in the die arranged so that the liquid metal entering the die would impart a generally cyclonic motion at the interface zone between the liquid and solid alloy material. This cyclonic motion caused shearing of primary dendrites in the alloy material from adjacent the internal side wall of the die and distributed those dendrites across the interface zone to provide nuclei for equiaxed crystals, thereby preventing the formation of thermal gradients in the alloy material of a sufficient magnitude to produce gross directional solidification at the interface zone.

Using the continuous casting arrangements disclosed in U.S. Pat. No. 4,315,538 has taught that their ability to produce fine grain structures in tubes with wall thicknesses of more than 0.5 inch could be improved. Accordingly, the subject of this invention is a die construction for use with the same type of continuous casting apparatus, but with an improved ability to produce a fine grain structure in tubes with wall thicknesses more than 0.5 inch, as well as in other cast shapes, such as round shaped rods.

BRIEF DESCRIPTION OF THE INVENTION

In the present invention, an improved method and apparatus are provided for obtaining a fine grain structure in a continuous cast alloy tube or rod. In such a continuous casting operation, liquid alloy material flows from a reservoir into a hollow die for transformation into the solid state or phase having the configuration of the die cavity. The tube or rod being cast is continuous in nature and exits from a die output end. Broadly, the method comprises the steps of delivering molten metal to the hollow die in a manner which prevents the presence or development of thermal gradients which are large enough to produce gross directional solidification at the interface or alloy transition zone wherein the metal cools from a liquid to a solid state.

In accordance with the preferred method, liquid alloy is delivered into the die in a manner causing turbulence at the interface or alloy transition zone. Such action facilitates even heat distribution and advantageously provides for the development of a desirable type of crystalline or grain structure. The improved arrangement facilitates obtaining a continuous cast copper alloy rod or tube having a fine grain structure. The improvement itself comprises means associated with the die cap for causing uniform temperatures in the liquid alloy at the interface zone of the die. These means prevent the presence or development of any thermal gradients which are large enough to produce gross directional solidification of the alloy. The means for causing also effects an even distribution of solid particles which have been sheared off parent crystals. These particles act as nuclei.

In accordance with the preferred arrangement of the invention, the means for causing comprises a plurality of feed slots located in the die cap and arranged relative thereto and to each other so as to automatically produce turbulence in the liquid alloy at the interface zone.

The principal object of the present invention is the provision of a new and improved method and apparatus to effect fine grain structure in continuous cast alloy tubes with wall thicknesses greater than 0.5 inch and other cast shapes.

Another object of the invention is the provision of such method and apparatus which are relatively simple and easy to implement into practical application.

A still further object of the present invention is the provision of method and apparatus which allow continuous cast alloy tubes and rods to be cold drawn or subsequently processed without encountering adverse rod cracking or the like.

Still other objects and advantages for the invention will become readily apparent to those skilled in the art upon a reading and understanding of the following specification.

BRIEF DESCRIPTION OF THE DRAWINGS

The invention may take physical form in certain parts and arrangements of parts, preferred and alternate embodiments of which will be described in detail in this specification nd illustrated in the accompanying drawings which form a part hereof, and wherein.

DESCRIPTION OF PREFERRED EMBODIMENTS

Figure 1:
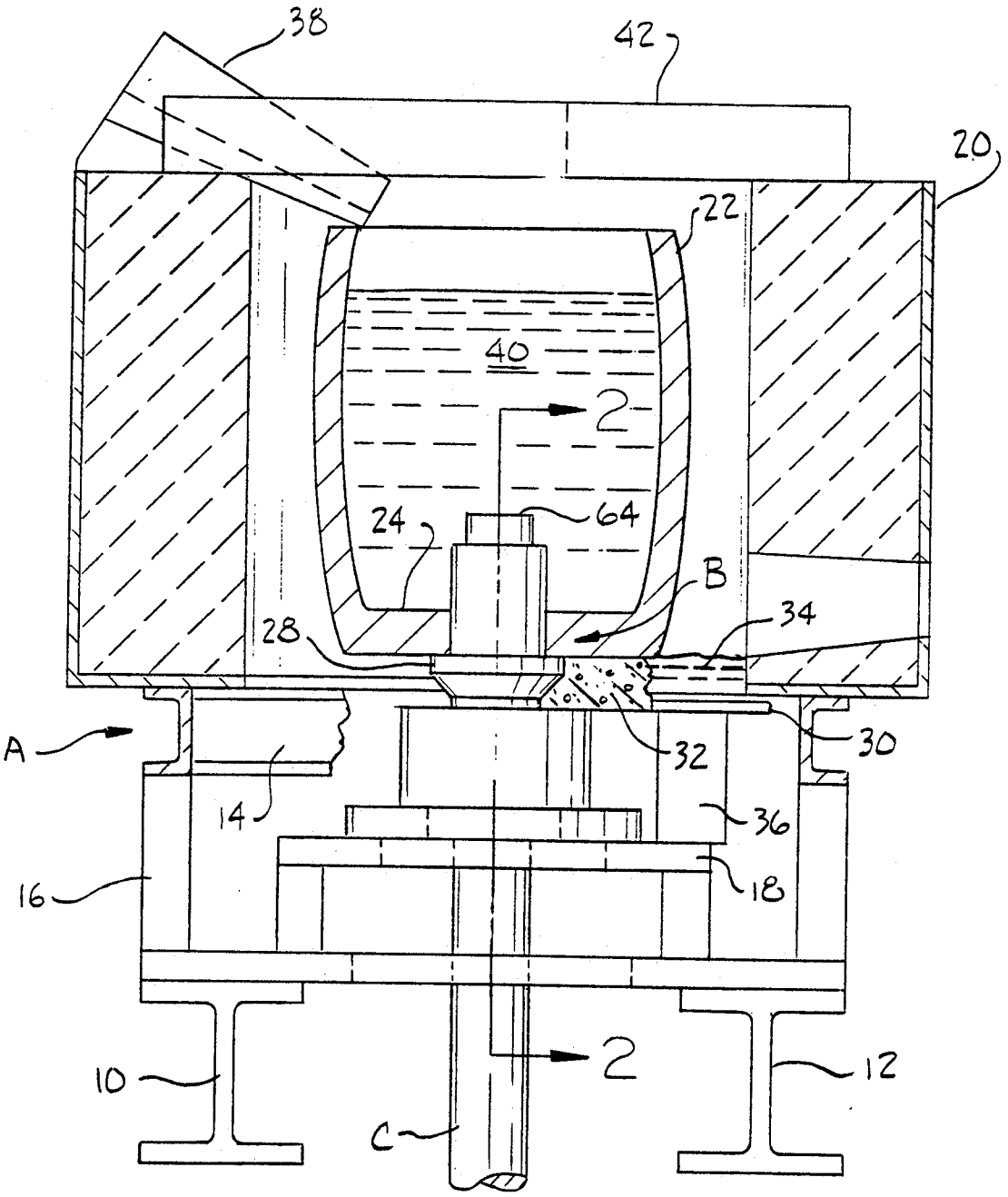
FIG. 1 is a somewhat schematic view in partial cross-section of a typical facility used in continuous casting of metallic rod and tube members for ease of appreciating the general environment to which the invention is particularly directed.

Referring now to the drawings, wherein the showings are for purposes of illustrating the preferred embodiment of the invention only and not for purposes of limiting same, FIG. 1 shows a continuous vertical casting facility A including a die and cooler assembly cap B for the continuous casting of a solid rod member or tube C. While many different metals, including brass, aluminum, bronze and the like, are cast by using such apparatus, the subject invention as described herein focuses on the continuous casting of copper alloy materials into solid rods or tubes.

More particularly, continuous casting facility A may comprise any number of types of styles of such facilities which could advantageously incorporate the concepts of the subject invention thereinto. One such facility is generally schematically shown in FIG. 1 and includes a pair of spaced apart beam-like bases 10, 12 supporting upper frame members generally designated 14, 16. A platform type arrangement generally designated 18 is supported by members 10, 12 which itself, supports a portion of die and cooler assembly B. Platform type arrangement 18 includes suitable openings therethrough in line with the die and cooler assembly to permit passage of tube or rod C therethrough. An open ended cylindrical holding furnace sleeve 20 is supported by frame members 14, 16 and receives a generally cup-shaped crucible 22 therein. Crucible 22 acts as a liquid alloy reservoir and includes a bottom wall 24 having a portion of die and cooler assembly B extending therethrough. A radially outward extending flange 28 on the die and cooler assembly engages the underside of bottom wall 24 to provide a convenient locating relationship between these components.

A bottom plate generally designated 30 is supported by a portion of the die and cooler assembly closely adjacent the bottom of holding furnace sleeve 20. This bottom plate in turn provides a base for a cementitious material generally designated 32 disposed about the lowermost end of the crucible and around a portion of the die and cooler assembly. Plate 30 further provides a base for fire clay material 34 interposed between cementitious material 32 and inner wall of sleeve 20. Fire clay brick generally designated 36 is conveniently interposed between platform 18 and the lower surface of bottom plate 30. A pouring spout generally designated 38 facilitates pouring of molten copper alloy metal 40 from outside the holding furnace to crucible 22 and the holding furnace lid 42 is conveniently provided to cover the top of sleeve 20 to thereby substantially enclose the crucible.

During a continuous casting operation, tube or rod member C emerges in a generally vertical disposition from the lower end of die and cooler assembly B. In the type of casting process to which the subject invention is particularly directed, appropriate pinch rolls (not shown) are disposed beneath the die and cooler assembly for withdrawing the tube or rod from the die as it is being cast. These pinch rolls are conventional and include means for coordinating the operation of the remainder of the facility components for achieving the desired physical characteristics for rod or tube C in a manner to be described hereinafter.

Casting facility A as shown in FIG. 1 merely comprises a general or schematic showing of the various components as well as their relative relationships to each other for permitting an appreciation of the particular environment hereinvolved. The specific construction, components and so on may vary between the individual continuous casting facilities and such variances are not deemed to in any way effect the overall scope or intent of the present invention. Moreover, and in view of the fact that the facility itself does not form a part of the invention and that operation thereof is generally known in the art, a further detailed description thereof is deemed unnecessary to permit those skilled in the art to have a full and complete understanding of the invention.

Figure 2:
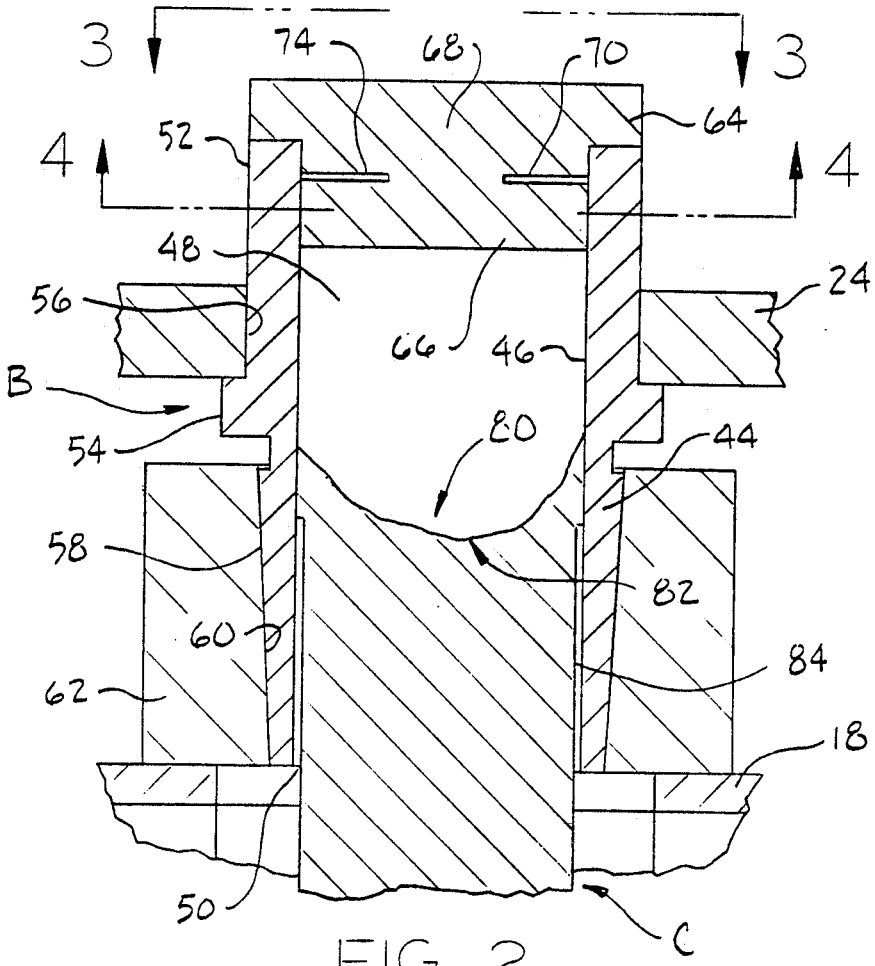
FIG. 2 is a partial cross-sectional view taken along lines 2—2 of FIG. 1 for showing the die and die feed slots utilized in practicing the subject invention.

In that regard, FIG. 2 shows a partial cross-sectional view of die and cooler assembly B and a portion of a continuous rod or tube C during casting thereof. Also shown is the area of interface between the die and cooler assembly with crucible or reservoir 22. More particularly, the casting die is comprised of a somewhat tubular shell-like arrangement generally designated 44. This shell-like arrangement may be constructed from any number of different materials commonly associated with such dies. In the preferred arrangement, the internal surface 46 defines a cylindrical die cavity between the die entrance end or area generally designated 48 and the opposite exit end or area generally designated 50. It will be appreciated that the internal surface could take other cross-sectional configurations and is dependent upon the outer wall configuration for the rod or tube itself.

Outer wall 52 of shell 44 has a generally cylindrical configuration over the upper end thereof and a radially outward extending flange 54. As is seen in FIG. 2, the die upper end is closely received through opening 56 in bottom wall 24 of the crucible with flange 54 then closely engaging the outside of the crucible bottom wall. The die outer wall portion 58 has a tapered configuration tapering inwardly from adjacent flange 54 toward exit end 50 and is adapted to be closely received against a tapered inner wall 60 of a cooler 62.

Cooler 62 may comprise any type of conventional cooling manifold for purposes of cooling the die and strand during a continuous casting operation and does not, in and of itself, form any part of the present invention. Accordingly, further description thereof is deemed unnecessary except to the extent that coolant is typically circulated through the manifold with the coolant inlet being spaced toward die exit end 50 and the coolant outlet being spaced adjacent the upper end.

Figure 3:
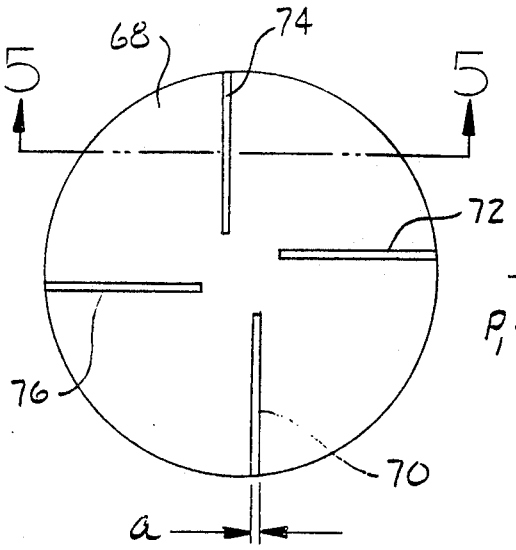
FIG. 3 shows the view on the die from the top.

With continued reference to FIG. 2, as well as reference to FIG. 3, a cap or plug member designated 64 acts as a cover for the open upper end of shell 44 adjacent area 48 for preventing ingress of liquid alloy into the shell at that area. Cap 64 includes a first cylindrical portion 66 closely received within the shell top end area and a second slightly larger portion 68 which defines a radial flange disposed in engagement with the shell upper end face.

Figure 4:
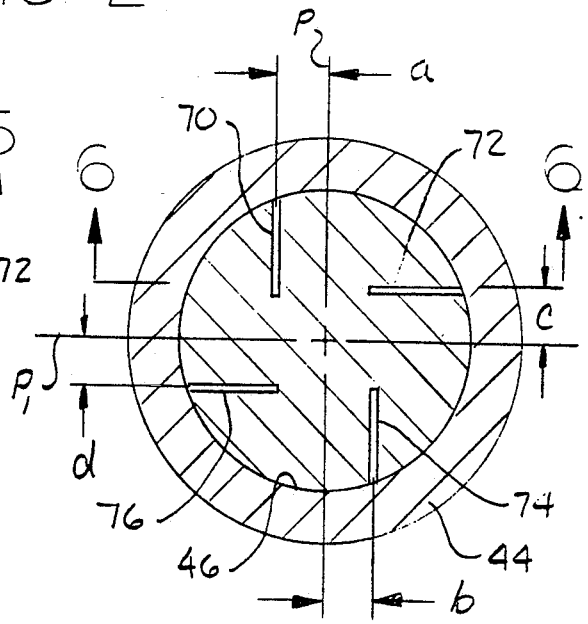
FIG. 4 is a partial cross-sectional view taken along lines 4—4 of FIG. 2 for showing the press of the die cap.

To accommodate delivery of liquid alloy material from crucible or reservoir 22 into the die, a plurality of equidistantly spaced-apart feed slots advantageously penetrate the cap 64. As shown in FIGS. 3, 4 and 5, such feed slots 70, 72, 74 and 76 are provided. However, a greater or lesser amount of such slots may be advantageously utilized or desired for continuous casting of certain rod or tube sizes and/or materials. As will be seen from FIGS. 3, 4, and 5, the feed slots incline through cap 64 toward inner cavity 48.

FIG. 5 illustrates three different ways for disposal of feed slots in die cap 64. In variant A and B the slots do not intersect the center line of the cap. In variant A the slot is inclined toward the center line, while in variant B the converse is true. In variant C, the slot intersects the center line. Each variant has a significant effect on the character of the liquid alloy motion near the freezing zone. The choice of which variant to use in a given situation depends upon the properties of the liquid alloy and the casting size.

In FIG. 6, two different ways of making slots in die cap 66 are shown using wedge 78. The choice of which way is very important, because failure to make the slots properly will render the die cap too weak and it will break under pressure in the crucible.

Referring to FIG. 2, it will be noted that feed slots 70, 72, 74 and 76 are disposed about shell 44 in an offset type of relationship. This feature acts to provide desirable liquid metal alloy entry into the die cavity in a manner to be described hereinafter. With regard to the spacing of these feed slots, FIG. 4 shows a pair of diametral planes P, P' which are normal to each other and extend longitudinally of shell 44. Plane P is disposed parallel to the center lines of feed slots 70, 74 and plane P' is disposed parallel to the center lines of feed slots 72, 76. In order to achieve the best overall operation or results, the lateral distances or spacings a, b of the center lines for feed openings 70, 74 are disposed in opposite directions from diametral plane P and the lateral distances c, d of the center lines for feed openings 72, 76 are disposed in opposite directions from diametral plane P', and are calculated to have a preferred value. The method of calculation of these distances for symmetrical slot locations is given below.

In a continuous casting operation utilizing the above described die construction in conjunction with the general type continuous casting apparatus which was described with reference to FIG. 1, the upper ends of feed slots 70, 72, 74 and 76 are disposed in communication with crucible 22. Thus, molten or liquid metal alloy material flows from the crucible or reservoir into the interior of the die through the plural feed slots as designated by the arrows in FIG. 7.

Because of the relative relationships between these feed slots and the die cavity as shown in FIGS. 2 and 7, a very strong motion is imparted to the liquid metal alloy as it enters the die cavity. This motion is generally designated by arrows X and causes generally uniform temperatures to be generated in the liquid alloy material as it proceeds downwardly through the die to the so-called near freezing zone. This near freezing zone is spaced below the feed slots themselves and is generally designated 80 in FIG. 2. In addition, the motion sheers the primary dendrites disposed adjacent or near the die interior wall 46 and distributes them across the interface zone generally designated 82. Such distribution advantageously provides nuclei for equiaxed crystal growth at random locations in the interface zone.

Interface or transition zone 82 is immediately adjacent near freezing zone 80 and comprises that area at which the liquid alloy or semi-liquid alloy transforms into the solid state to thus define rod or tube C. The intermittent movement of pinch rolls (not shown) in pulling the strands outwardly from die exit end 50 allows this transformation to be substantially completed at an appropriate area within the die itself. Typically, each intermittent movement or stroke of the pinch rolls may move the strands somewhere in the range of approximately 0.5 inch to 1.0 inch at 30 inches per minute at various time intervals between the strokes.

During transformation from a liquid to a solid state, the above-described motion of the liquid alloy toward and at near freezing zone 80 effects even heat distribution in the alloy material during the transition to a solid state. The even heat distribution, in turn, prevents or eliminates formation of thermal gradients of a sufficient magnitude to produce cross directional solidification of the alloy. As described hereinabove, such cross directional solidification results in the unacceptable type of macro structure shown in FIG. 2 of U.S. Pat. No. 4,315,538.

As rod or tube C is moved axially through the casting die from interface or transition zone 82, there will be some shrinkage of the rod in its transformation to the final solid state. Thus, FIG. 2 shows the outside wall 84 of the rod as being slightly spaced radially inward from die internal wall 46 as the liquid or molten copper alloy has solidified and begun to cool. Cooling of the rod or tube is facilitated by cooler 62. As previously noted, this cooler may comprise any number of types of cooling arrangements and typically provides for the passing of cooling fluid or water therethrough in a direction generally opposite to the movement of rod or tube C.

It has been found that in using the subject invention in accordance with the above-described preferred embodiment, a polygonal-type grain structure having fine grain boundaries such as is shown in FIG. 3 of U.S. Pat. No. 4,315,538 is readily obtained. Moreover, the grain size thus achieved is quite small compared to previously known and used continuous casting techniques. This result is extremely beneficial for continuous casting of alloy rods and tubes in that it facilitates subsequent cold drawing or working of said rods or tubes without causing cracks or other imperfections therein.

From these initial considerations, the method of calculating the die design shown in FIG. 7 has been derived. FIG. 7A shows the position of interface zone 82 in dwell-time of the withdrawal cycle. FIG. 7B shows the same just at the end of stroke $Z_S$. FIG. 7C shows the press of cap 66 (toward the interface zone). FIG. 7D shows the top of cap 68 (toward crucible). FIG. 7 includes a tapered mandrel 86 as disclosed in U.S. Pat. No. 4,154,291, which is used in making tubes. The angle between the slot and the vertical axis of the die is labelled $\alpha$, the angle between the tapered portion of the mandrel and the vertical axis of the die is labelled $\alpha_2$.

Figure 7A:
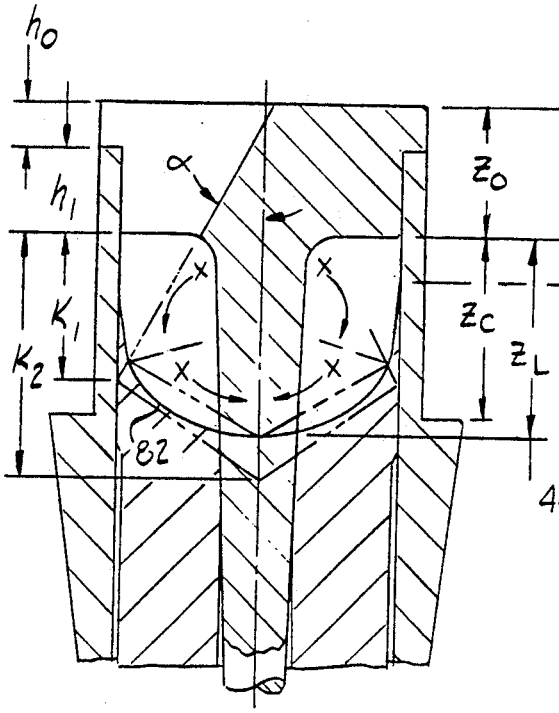
FIGS. 7A-7D show the various angles and dimensions used in calculating the design of the die cap, to provide the optimum conditions for formation of fine grain structures.
Figure 7B:
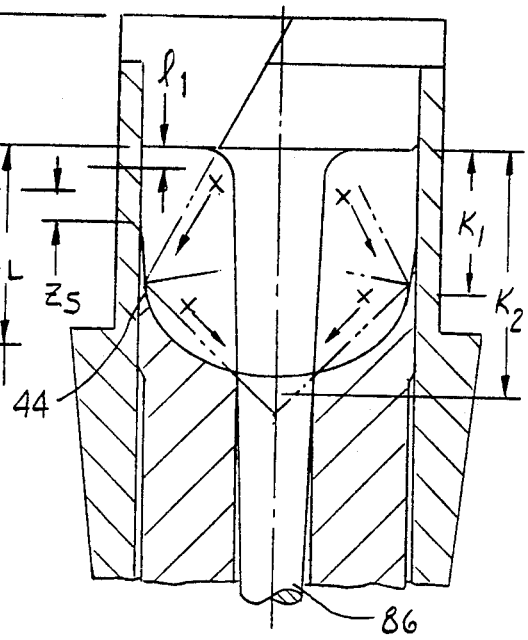
Figure 7C:
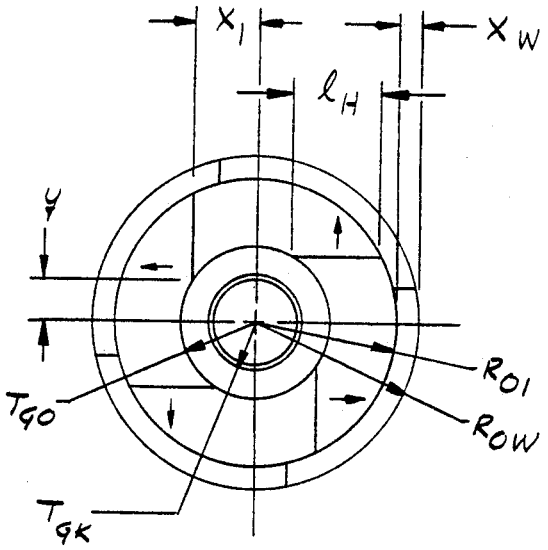
Figure 7D:
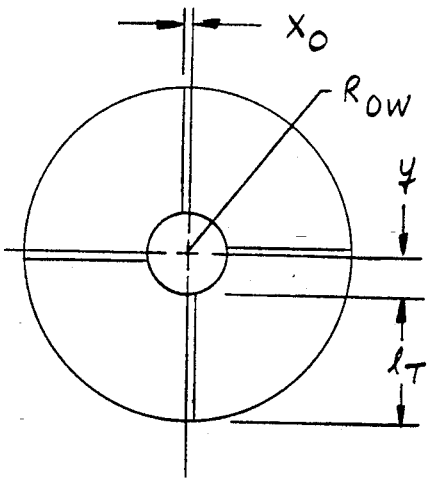

The best conditions for obtaining motion of the liquid metal near the interface zone 82 are obtained if the liquid metal streams entering the die cavity hit the interior wall of the shell 46 and then reflect off the shell and meet with each other near the center part of the interface zone, forming strong circulation torrents. The flow of the liquid metal is shown in FIGS. 7A and 7B by dotted lines. The liquid metal just near zone 82 should have strong turbulency thereby eliminating large thermal gradients between solid and liquid phases. To obtain a sufficiently turbulent metallic stream, the die cap must be thick and the slot must be narrow and long. Experimentation has shown that the height of the cap ($Z_O = h_0 + h_1$, where $h_0$ is the thickness of the flange area of the cap, and $h_1$ is the thickness of the press of the cap) should be no less than one and one quarter inches. The minimum width of the slots for casting metals with high fluidity should be approximately 1/16th inch, and the minimum width for all other metals should be approximately ⅛th inch.

For casting round solids, the maximum length of the slot measured on the interior surface of the press of the cap is estimated as:

$$l_H = 0.88 R_{01} \tag{1}$$

where $R_{01}$ is the radius of the die cavity 48. For known angle $\alpha$ and distance $K_1$, the distance between the bottom surface of the die cap and the point at which a line drawn along the angle $\alpha$ at the midpoint of the slot intersects the interior wall of the shell 46, it is possible to determine the right number n and location of slots from the following equations:

$$\Omega = K_1 \tan \alpha \tag{2}$$

where $\alpha$ is the angle between the longitudinal die axis and the centerline of each feed slot, and $\Omega$ is the distance on the interior surface of the press of the die cap 66 between the midpoint of the feed slot and the die sidewall measured in the direction of alloy stream flow.

$$x_1 = l_H \sqrt{\frac{R_{01}^2}{l_H^2 + 4\Omega^2} - \frac{1}{16}} - \frac{\Omega}{2} \tag{3}$$

where $R_{01}$ is the radius of the die and $x_1$ is the minimum offset distance between the centerline of each feed slot and its parallel diametral plane on the bottom surface of the die cap press 66.

$$y_1 = \sqrt{R_{01}^2 - x_1^2} - l_H \tag{4}$$

where $R_{01}$ is the radius in inches of the die, and $y_1$ is the distance in inches from the internal end of each feed slot to the diametral plane perpendicular to said slot.

$$\tau_{go} = \sqrt{x_1^2 + y_1^2} \tag{5}$$

where $\tau_{go}$ is the radius in inches of a circle on the bottom surface of the die cap within which no slot should be located and $y_1$ is the distance in inches from the internal end of each feed slot to the diametral plane perpendicular to said slot.

$$B_{OS} = \begin{cases} 10\,K \cdot OD & \text{at } OD < \frac{4}{K} \\ 40 & \text{at } OD \geqq \frac{4}{K} \end{cases} \tag{6}$$

where OD is the diameter of the casting in inches and K is the ratio of fluidity of the metal to high fluidity (K is less than or equal to 1). For example, for alloy CDA 260 K=1, and for alloy CDA 932 K=⅔.

$$n > 3.927 \frac{R_{01}}{B_{OS}\, a'} \tag{7}$$

where n is the number of feed slots, $R_{01}$ is the radius in inches of the die, $B_{OS}$ is calculated in accordance with equation 6, and a' is the width of the feed slots.

For casting tubes the optimum number of slots may be obtained by equation:

$$n_T \geqq 3.927 \frac{R_{01}}{B_{OS}\, a'} + 1 \tag{8}$$

where $R_{01}$ is the radius in inches of the die, $B_{OS}$ is calculated in accordance with equation 6, a' is the width of the feed slots, and $n_T$ is the number of feed slots.

The length of each slot on the press, $l_H^T$, calculated from the amount of liquid metal required to pass through each slot, can be found using the following equation:

$$l_H^T = 3.456 \frac{R_{01}^2 - \tau_{gk}}{B_{OS}\, n_T\, a'} \tag{9}$$

where $\tau_{gk}$ is the maximum radius of the tapered mandrel part.

Because of the necessity to keep the mandrel strong so as to prevent pull out, no slot should be located within a circle located on the outer surface of the die cap and defined by the radius $\tau_{go}$. Thus the location of the slots and the angle $\alpha$ should be calculated using the following equations:

$$\tau_{go} = \tau_{gk} + \Delta \tag{10}$$

where $\tau_{gk}$ is the maximum radius of the tapered mandrel part and $\Delta$ is the distance for the fillet from $\tau_{gk}$ to $\tau_{go}$. Usually the minimum $\Delta$ is equal to 1.0 inch at the fillet height 0.25 inch.

$$y_1 = \frac{R_{01}^2 - (l_H^T)^2 - \tau_{go}^2}{2l_H^T} \tag{11}$$

where $y_1$ is the distance in inches from the internal end of each feed slot to the diametral plane perpendicular to said slot.

$$x_1 = \sqrt{\tau_{go}^2 - y_1^2} \tag{12}$$

where $x_1$ is the offset distance between the centerline of each feed slot and its parallel diametral plane on the bottom surface of the die cap press 66.

$$\Omega = \sqrt{R_{01}^2 - \left(\frac{l_H^T}{2} + y_1\right)^2} - X_1 \tag{13}$$

where $y_1$ is the distance from the internal end of each feed slot to the diametral plane perpendicular to said slot, calculated in accordance with equation 4, and $\Omega$ is the distance on the press between the mid point of the slot and the inner shell wall 46 in the direction of metallic flow.

$$\alpha = \arctan\left(\frac{\Omega}{K_1}\right) \tag{14}$$

where $K_1$ is the distance between the bottom surface of the die cap and the point at which a line drawn along the angle $\alpha$ intersects the interior wall of the shell 46.

Figure 5A:
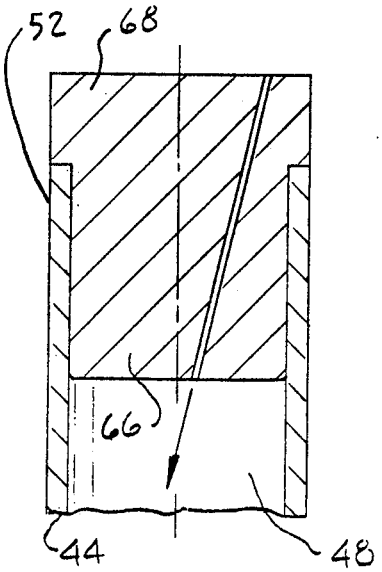
FIGS. 5A-5C show different ways for disposal of slots in the die cap taken along lines 5—5 of FIG. 3.
Figure 5B:
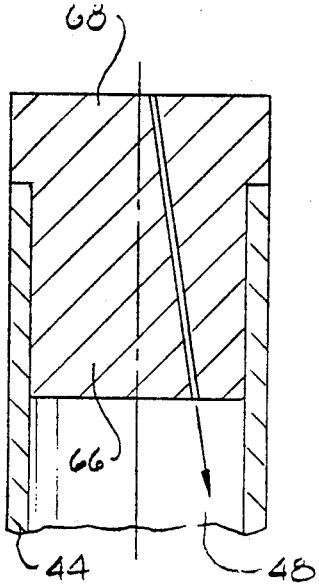
Figure 5C:
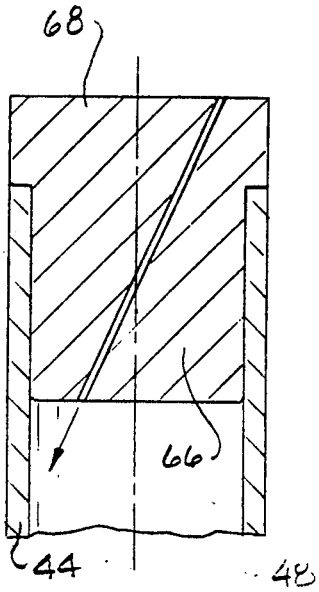

Analysis of these results shows that, when the height of the die cap $Z_O = 1.25$ inch, for casting round solids from alloy CDA 932 with diameters from 1 to 6.5 inches, four slots with ⅛th inch widths should be made with an angle $\alpha = 30°$ using variant 3 (FIG. 5C). For diameters over 6.5 inches, but less than 8.25 inches, variant 2 (FIG. 5B) should be used. For diameters over 8.25 inches but less than 10.25 inches, five slots should be used, and so on. The angle $\alpha$ increases with the increase of solid diameter and outside diameter of tubes (at the same inside diameter). At the same outside diameter, angle $\alpha$ should be decreased if the inside diameter increases.

Because the presence of these slots can significantly weaken the die cap and thus reduce its ability to withstand the pressure caused by the flow of the molten metal, and the withdrawal force as the solidified tube or rod is withdrawn from the die, no slot should be located in the die cap within an area defined by a cylinder the axis of which is located at the axis of the die cap and which has a minimum diameter of $\phi_S^{min}$. This minimum diameter can be calculated by the following formula:

$$\Phi_s^{min} \geqq \frac{4}{3}\tau_{gk} \tag{15}$$

where $\tau_{gk}$ is the maximum radius of the tapered mandrel part.

Figure 6A:
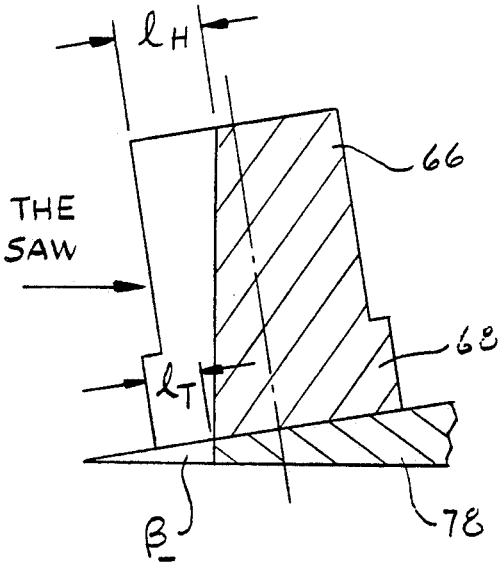
FIGS. 6A-6B show the different ways to make slots in the die cap, the view being taken along lines 6—6 of FIG. 4.
Figure 6B:
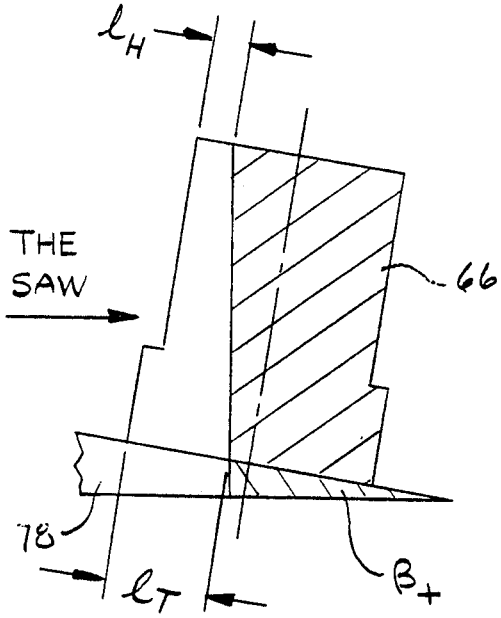

In determining the cap design based on this restriction, the positive foundation wedge shown in FIG. 6B should be used unless equation 15 proves to be invalid, i.e., when $\phi_S^{min}$ calculates to be very small, which would produce a weak cap, in which case the negative foundation wedge of FIG. 6A should be used.

Thus, with respect to FIG. 5, the feed slots generally should be disposed in accordance with FIG. 5A when $x_1 > 0$, where $x_1$ is calculated in accordance with Equation 12, $x_0 > 0$, where $x_0$ is the distance between a diametral plane and the nearest edge of the parallel feed slot, measured on the exterior surface of the cap and calculated by the following equation: $x_0 = x_1 - (h_0 + h_1)\tan\alpha$, and $x_0 > x_1$. The feed slots generally should be disposed in accordance with FIG. 5B when $x_1 > 0$, $x_0 > 0$, and $x_1 > x_0$. The feed slots generally should be disposed in accordance with FIG. 5C when $x_1 > 0$ and $x_0 < 0$.

The benefits described hereinabove are not limited to round shapes. Die designs may also be employed using ovals, rectangles and so on. Table 1 below contains tabulations of cap designs for casting solids and tubes from commonly used alloys.

TABLE 1*

| Alloy (nominal comp.) | K | Size | ho (FIG. 7A) | n | a' | $K_1$ (FIG. 7A) | Variant (FIG. 5) | Angle $\alpha$ (FIG. 7A) | $X_1$ (FIG. 7C) | $Y_1$ (FIG. 7C) | $l_H$ (FIG. 7C) | $\tau_{go}$ (FIG. 7C) | $\Phi_s^{min}$ (FIG. 7C) |
|---|---|---|---|---|---|---|---|---|---|---|---|---|---|
| CDA 932 Copper - 83% | 2/3 | 1.969 | 1 | 4 | ⅛ | 1.188 | C | 30° | .150 | .108 | .880 | .185 | .216 |
| Lead - 7% Tin -7% | | 10.340 | | 5 | | 3⅛ | B | 37° | 2.313 | .096 | 4.620 | 2.315 | 1.810 |
| Zinc - 3% | | 3.000 × 8.125 | | 5 | | 3⅛ | B | 30° | 1.194 | 1.731 | 2.225 | 2.102 | 3.469 |
| | | 7.000 × 9.000 | | 5 | | 1.211 | B | **25.5° | 3.146 | 1.924 | 1.400 | 3.688 | 7.189 |
| PM6009F Copper - 68% | 1 | 1.062 | ⅜ | 4 | 1/16 | .502 | C | ***26° | .235 | .012 | ..475 | .235 | .089 |
| Lead - 30% Tin - 2% | | 3.495 | ⅜ | 5 | | 1⅞ | C | 30° | .422 | .162 | 1.563 | .452 | .325 |
| | | .565 × 2.055 | ½ | 5 | | .825 | C | ***26° | .485 | .180 | .746 | .517 | .495 |
| | | 3.125 × 5.375 | ½ | 6 | | 1.401 | B | 30° | 1.647 | .278 | 1.907 | 1.670 | 1.794 |

*All dimensions are given in inches. It is taken $h_1$ = ⅛". Distances $X_1$ and $l_H$ calculated for the closest slot side on the press to the proper center line. Parameter determinations shown in the text.
**Used wedge with negative angle 27°.
***Used wedge with negative angle 4°.

Figure 8A:
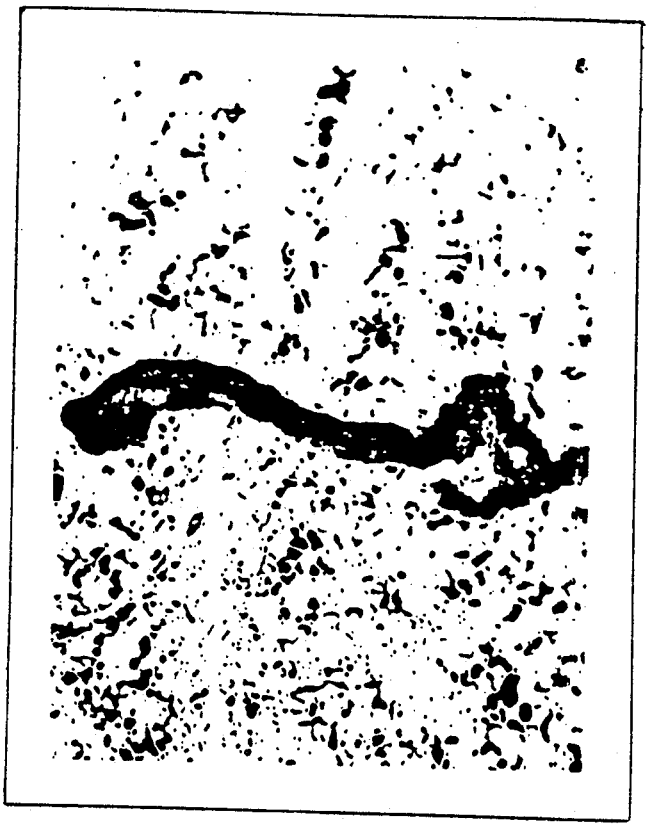
FIGS. 8A-8B show the difference in lead uniformity in transverse direction under 100× in castings from 30% leaded copper bronze if using known die design (a) or subject invention (b).
Figure 8B:
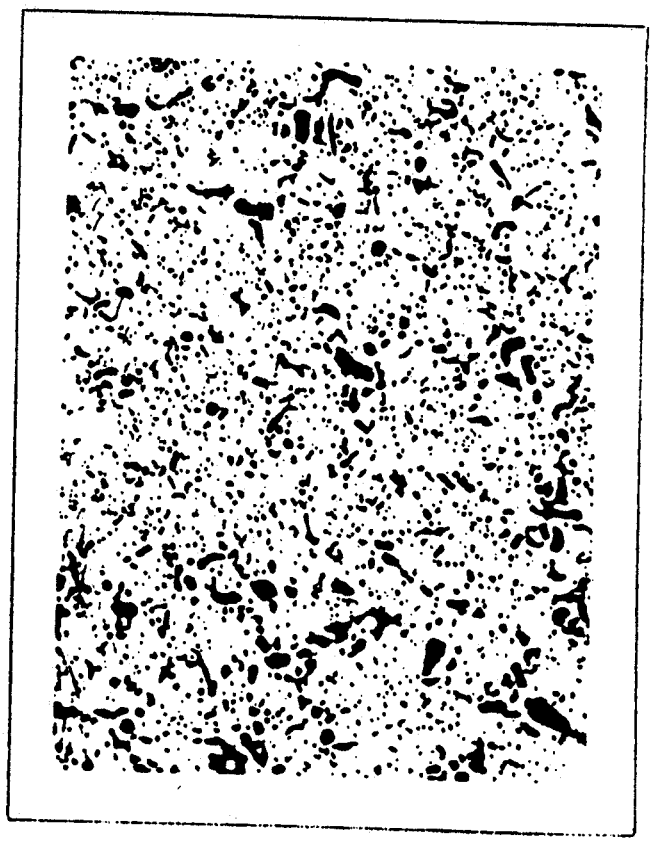

Using the die cap designs shown in Table 1 will result in the fine grain structure shown in FIG. 8B.

The benefits of the subject invention as described hereinabove are not limited to cold drawing of stock. In rolling, for example, large grains cause wrinkled surfaces in areas where the casting is not supported by the rolls. Fine grain billets obtained by using the general concepts of the invention eliminate this problem. Further, in cast leaded bronze alloys, the subject fine grain process will provide improved lead dispersions over those obtained when using currently available techniques and apparatus for making tubes with wall thicknesses greater than 0.5 inch.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

Having thus described the preferred embodiments, the invention is claimed as follows:

1. An apparatus for continuous casting of an elongated rod or tube having a polygonal grain structure and fine grain boundaries, comprising:

a reservoir adapted to receive an alloy material in its liquid state;

a hollow continuous casting die having a first entrance end, a sidewall parallel to an axis extending longitudinally of the die connecting to a second exit end, an interior cross-section approximately conforming to the rod or tube to be cast, a transition zone, and an interface zone;

a die cap sealingly connected to the die at the first entrance end having an exterior first surface and an interior second surface and configured to be completely submerged in the reservoir when containing liquid alloy material;

a plurality of alloy feed slots forming passages through the die cap such that the feed slots provide flow communication between the reservoir and the interior of the die at an angle to the die axis greater than zero degrees and less than ninety degrees such that a stream of alloy material flowing into the die through each alloy feed slot is focused on the sidewall such that the stream deflects approximately toward the axis of the die at the interface zone so as to produce turbulence at the interface zone from the convergence of the streams;

means for cooling the casting;

means for withdrawing the rod or tube from the die on a continuous basis.

2. The apparatus as defined in claim 1 wherein the exterior first surface is at least about one and one-quarter ($1\frac{1}{4}$) inches from the interior second surface of the die cap.

3. The apparatus as defined in claim 1 wherein the feed slots are disposed within the die cap at an angle $\alpha$ to the longitudinal axis of the die and determined by an equation:

$$\alpha = \arctan\left(\frac{\Omega}{K_1}\right)$$

where $\Omega$ is a distance on the interior second surface of the die cap between a midpoint of the feed slot and the die sidewall measured in a direction of alloy material stream flow through the die cap, and $K_1$ is a distance between the interior second surface of the die cap and a point at which a plane drawn through the feed slot at its midpoint intersects the die sidewall.

4. The apparatus as defined in claim 1 wherein n number of feed slots are disposed within the die cap where n is determined by an equation:

$$n > 3.927 \frac{R_{01}}{B_{OS}\, a'} \tag{7}$$

where $R_{01}$ is a radius of the die in inches, $B_{OS}$ is equal to 10K·OD, when OD<4÷K, and 40, when OD≧4÷K, where K is a ratio of fluidity and OD is a diameter of the casting in inches, and a' is the width of the feed slots.

5. The apparatus as defined in claim 1 wherein $n_T$ number of feed slots are disposed within the die cap where $n_T$ is determined by an equation:

$$n_T \geqq 3.927 \frac{R_{01}}{B_{OS}\, a'} + 1 \tag{8}$$

where $R_{01}$ is a radius of the die in inches, $B_{OS}$ is equal to 10K·OD, when OD<4÷K, and 40, when OD≧4÷K, where K is a ratio of fluidity and OD is a diameter of the casting in inches, and a' is the width of the feed slots.

6. The apparatus as defined in claim 1 wherein the feed slots are disposed radially within the die cap and offset equidistantly from a diametral plane extending longitudinally of the die.

7. The apparatus as defined in claim 1 wherein the feed slots are at least about 1/16th inch wide.

8. A method for continuous casting of an alloy rod or tube for obtaining a polygonal grain structure with fine grain boundaries, said method comprising the steps of:

providing a reservoir of alloy material in its liquid state, a hollow continuous casting die disposed in flow communication with said reservoir, and a die cap;

maintaining said alloy in its liquidus state at least adjacent the area of flow communication between said reservoir and die;

delivering said liquid alloy material from said reservoir to said die through feed slots completely submerged in said reservoir of liquid alloy material and disposed in said die cap at an angle to the die axis greater than zero degrees and less than ninety degrees;

transforming said liquid alloy material to a solid state in said die at an interface zone extending across the cross-sectional area of said alloy as said liquid alloy material moves through said die to said interface zone from a near freezing zone adjacent said interface zone;

said step of transforming said liquid alloy material to a solid state being carried out to obtain a general fine polygonal grain structure throughout substantially the entire cross-sectional area of said alloy at said interface zone by eliminating gross directional solidification of said alloy material at said interface zone;

said step of transforming said liquid alloy material to a solid state with a generally polygonal grain structure being carried out by maintaining the temperature of said liquid alloy material generally uniform throughout the cross sectional area thereof at least adjacent said near freezing zone; and said step of maintaining the temperature of said liquid alloy material generally uniform including the step of producing transverse movement of said liquid alloy material throughout substantially the entire cross-sectional area thereof adjacent said near freezing zone in a direction transverse to the direction of movement of said alloy material through said die, said step of producing transverse movement of said liquid alloy material being carried out by focusing entry of said liquid alloy material into said die through said feed slots so as to impart a generally cyclonic motion thereto during said step of delivering.

9. The method as defined in claim 8 wherein said step of focusing entry of said liquid alloy material into said die is carried out by arranging said feed slots as a plurality of liquid alloy feed slots radially spaced apart from each other within the die cap and offset from diametral planes extending longitudinally of the die.

10. The method as defined in claim 8 wherein said step of focusing entry of said liquid alloy material into said die is carried out by arranging said feed slots as a plurality of spaced apart liquid alloy feed slots disposed within said die cap and extending downwardly through said die cap at an angle to the longitudinal axis of the die.

* * * * *